US009551356B2

(12) United States Patent
Leesman et al.

(10) Patent No.: US 9,551,356 B2
(45) Date of Patent: Jan. 24, 2017

(54) DOUBLE BELL MOUTH SHROUD

(71) Applicant: Caterpillar Inc., Peoria, IL (US)

(72) Inventors: Kory Leesman, Hartsburg, IL (US); Jim Carroll, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 634 days.

(21) Appl. No.: 14/046,203

(22) Filed: Oct. 4, 2013

(65) Prior Publication Data

US 2015/0098818 A1 Apr. 9, 2015

(51) Int. Cl.

*B64C 11/00* (2006.01)
*F04D 29/52* (2006.01)
*F04D 29/16* (2006.01)

(52) U.S. Cl.

CPC ..... *F04D 29/526* (2013.01); *F04D 29/164* (2013.01)

(58) Field of Classification Search

CPC ..... B64C 27/12; B64C 27/16; B64C 27/20; Y02E 10/722
USPC ..... 416/169 R
See application file for complete search history.

(56) References Cited

U.S. PATENT DOCUMENTS 2,536,130 A * 1/1951 Herrman ..... F04D 29/545 415/222
3,028,072 A 4/1962 Atalla
3,858,644 A 1/1975 Beck et al.
4,132,912 A * 1/1979 Wright ..... H02K 9/14 310/62
4,173,995 A * 11/1979 Beck ..... B60K 11/02 123/41.49
4,221,546 A 9/1980 Papst et al.
4,768,472 A 9/1988 Hayashi et al.
5,183,382 A 2/1993 Carroll
5,520,513 A 5/1996 Kuroki et al.
5,649,807 A 7/1997 Lee et al.
5,884,589 A 3/1999 Sakamoto et al.
7,037,077 B2 5/2006 Oono et al.
7,794,204 B2 9/2010 Stevens et al.
8,221,074 B2 7/2012 Nelson

FOREIGN PATENT DOCUMENTS

EP 0645543 A1 3/1995
JP 4269326 A 9/1992
JP 07-077044 A 3/1995
JP 07-238832 A 9/1995

* cited by examiner

*Primary Examiner* — Eric Keasel
*Assistant Examiner* — Jason Mikus
(74) *Attorney, Agent, or Firm* — Baker & Hostetler LLP

(57) ABSTRACT

This disclosure relates generally to fan shrouds for machine fans, and, more particularly, to the structure and design of double bell mouth shrouds and placement of double bell mouth shrouds relative to a machine fan. In some examples, a fan shroud encircling a circular fan having a plurality of fan blades can be provided. Some example fan shrouds can include an inlet adapted to receive air and an outlet adapted to outlet air. The inlet can include an inlet radius, and the outlet can include an outlet radius. In some examples, the outlet radius can each be about 10% of the fan diameter.

20 Claims, 5 Drawing Sheets

DOUBLE BELL MOUTH SHROUD

TECHNICAL FIELD

This patent disclosure relates generally to fan shrouds for machine fans, and, more particularly, to structure and design of double bell mouth shrouds and placement of double bell mouths shrouds relative to a machine fan.

BACKGROUND

Conventional fan shrouds can improve airflow through a fan installed and/or operating on a machine. Fan shrouds can reduce airflow recirculation from high pressure to low pressure side of the fan, can reduce airflow entrance & exit losses in and out of the fan, and/or can reduce airflow separation and vortices near the fan blade tips. Improving fan shroud designs to maximize operation of the fan can be desirable.

Additionally, machines are generally compact and do not have much space for large components. Improving fan shroud designs to reduce the space needed to mount a fan shroud can also be desirable.

Japanese Patent No. 4269326 (JP '326), titled "Shroud of Cooling Fan for Radiator," purports to address improving fan shroud performance. The JP '326 patent describes a bell-mouth shaped fan shroud positioned between a radiator and a cooling fan, where the fan shroud design includes a ratio of 40% against the width of the fan's blades. The design of the JP '326 patent, however, provides a relatively large space requirement, and therefore the space that the fan shroud takes up on the machine can be less than optimal. Accordingly, there is a need for an improved bell mouth fan shroud and methods of designing and placing the bell mouth fan shroud.

SUMMARY

In some examples, the disclosure describes a fan shroud encircling a circular fan having a plurality of fan blades, where each fan blade has a blade depth and where the circular fan has a fan diameter. The fan shroud can include an inlet adapted to receive air, where its cross-section includes an inlet radius. The fan shroud can include an outlet adapted to outlet air, where its cross-section includes an outlet radius of about 10% of the fan diameter. The inlet and the outlet can be coupled to form the fan shroud. In some examples, the inlet radius can be about 10% of the fan diameter. In some examples, the fan shroud can include a shroud depth of about 20% of the fan diameter.

In some examples, the disclosure describes a fan shroud encircling a circular fan having a plurality of fan blades, where each fan blade has a blade depth and where the circular fan has a fan diameter. The fan shroud can include an inlet adapted to receive air, where its cross-section includes an inlet radius. The fan shroud can include an outlet adapted to outlet air, where its cross-section includes an outlet radius of about 7% of the fan diameter. The inlet and the outlet can be coupled to form the fan shroud. In some examples, the inlet radius can be about 4% of the fan diameter. In some examples, the fan shroud can include a shroud depth of about 11% of the fan diameter.

In some examples, the disclosure describes a method of designing a fan shroud for a fan on a machine. Example methods can include deriving shroud cross section performance map(s) representing fan sound, fan airflow, and/or total efficiency as a function of a plurality of specific diameters of the fan, deriving optimal fan projection map(s) representing a downstream projection as a function of the plurality of specific diameters of the fan, selecting a design for the fan shroud for the fan based, at least in part, on the shroud cross section performance map(s), and determining a placement of the fan shroud relative to the fan based, at least in part, on the optimal fan projection map(s).

DETAILED DESCRIPTION

Example fan shrouds can be installed on any machine that includes at least one fan (e.g., cooling fan, exhaust fan). It should be noted that the methods and systems described herein can be adapted to a large variety of machines. The machine can be an "over-the-road" vehicle such as a truck used in transportation or can be any other type of machine that performs some type of operation associated with an industry such as mining, construction, farming, transportation, or any other industry known in the art. For example, the machine can be an off-highway truck, earth-moving machine, such as a wheel loader, excavator, dump truck, backhoe, motor grader, material handler or the like. The term "machine" can also refer to stationary equipment like a generator that is driven by an internal combustion engine to generate electricity.

It should be noted that the Figures are illustrative only and they are not drawn to scale.

Figure 1:
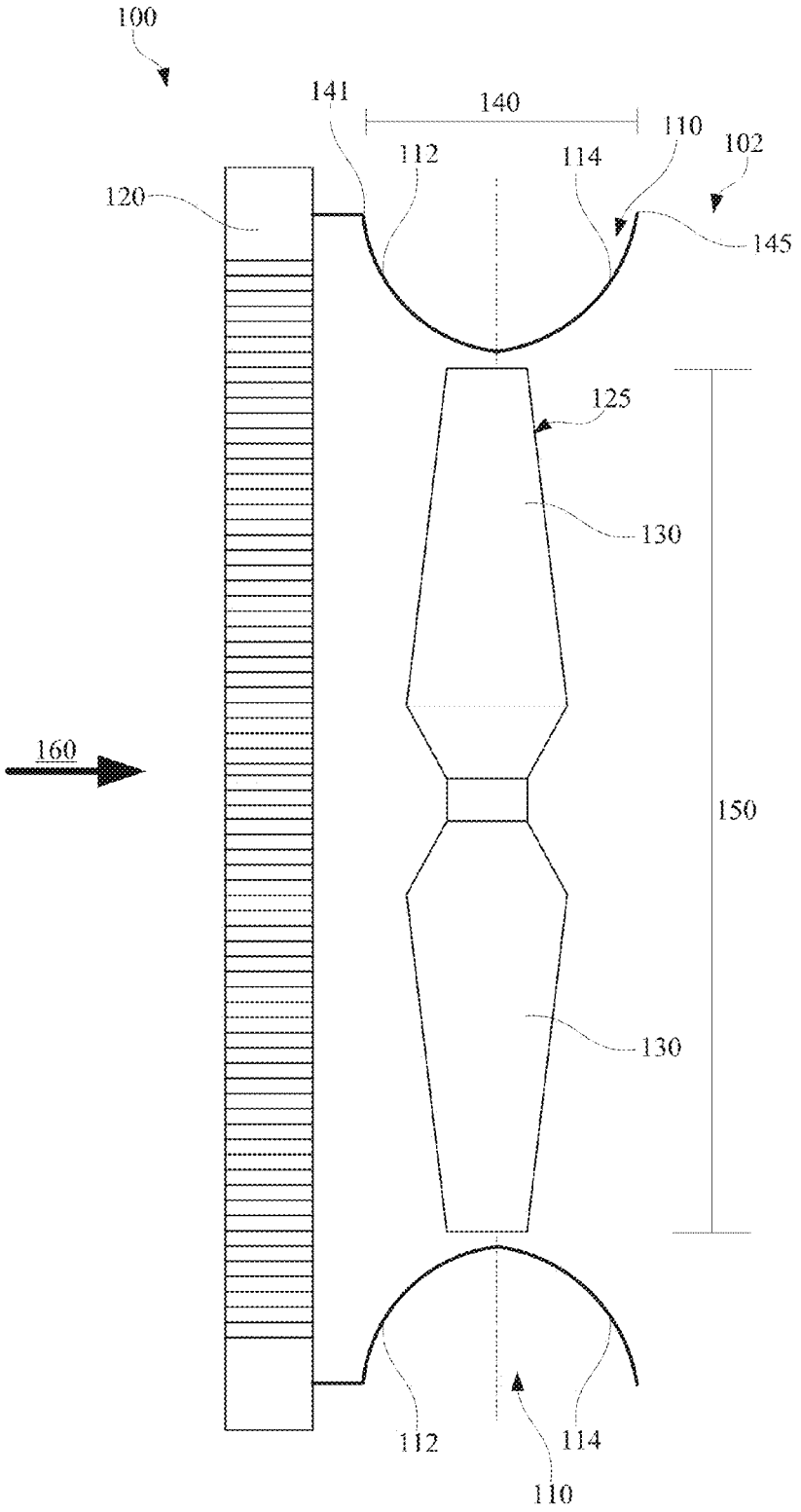
FIG. 1 is a cross-sectional view of an example double bell mouth shroud in accordance with at least one embodiment of the present disclosure.
Figure 2:
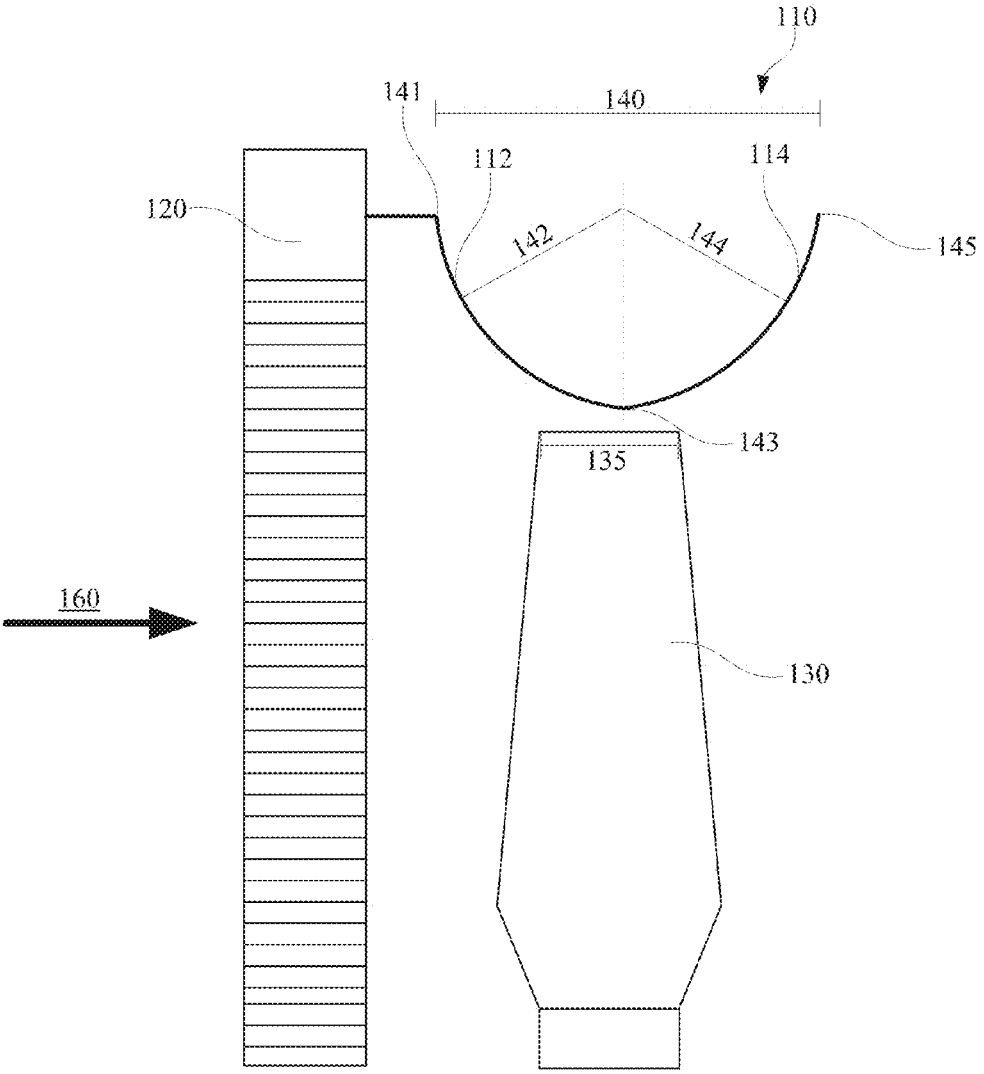
FIG. 2 is cross-sectional view of a portion of the example double bell mouth shroud of FIG. 1 in accordance with at least one embodiment of the present disclosure.

FIG. 1 is a cross-sectional view of an example fan shroud 110 in accordance with at least one embodiment of the present disclosure. FIG. 2 is cross-sectional view of a portion of the example double bell mouth shroud of FIG. 1. Fan shroud 110 can be installed about and/or can encircle a fan having fan blades 130. Fan shroud 110 can be coupled to radiator 120. Fan shroud 110 can receive a flow of air 160 through a radiator 120. In this manner, fan shroud 110 can direct the air 160 around and/or through the fan. The fan can have a fan diameter 150.

Fan shroud 110 can include an inlet 112 and an outlet 114. Inlet 112 can be adapted to receive the flow of air 160, while outlet 114 can be adapted to outlet the air 160. A cross-section of inlet 112 can include an inlet radius 142. Similarly, a cross-section of outlet 114 can include an outlet radius 144. Inlet 112 and outlet 114 can be coupled together.

Depending on various system goals, considerations, requirements, and/or parameters such as fan noise/sound, fan airflow, total efficiency, and available space on or in a machine, example fan shrouds can be designed. in some examples, the inlet radius 142 and outlet radius 144 can be designed have a specific value relative to fan diameter 150 to meet system goals, considerations, requirements, and/or parameters. In some examples, such as the example of FIG. 1, outlet radius 144 can be about 10% of fan diameter 150. Similarly, in some examples, such as the example of FIG. 1, the inlet radius 142 can be about 10% of fan diameter 150.

Inlet 112 and outlet 114 can be directly coupled so as to not have a shroud duct between them. In conventional fan shrouds, inlets and outlets are coupled via a cylinder or shroud duct between them. Example fan shroud 110 includes a direct coupling of inlet 112 to outlet 114. In FIGS. 1 and 2, inlet 112 is delineated from outlet 114 using a dashed line.

Example fan shroud 110 has a shroud depth 140 that can also be designed based on various system considerations, requirements, and/or parameters. In some examples, such as the example of FIG. 1, shroud depth 140 can be about 20% of fan diameter 150.

Inlet 112 and outlet 114 can be substantially shaped as a bell mouth shape. The cross-section view of FIG. 1 exhibits an example inlet 112 and outlet 114 each having a bell mouth shape. From the perspective of the flow of air 160, inlet 112 can have a radially converging shape, while the outlet 114 can have a radially diverging shape.

The inlet 112 of the fan shroud 110 can extend along its inlet radius 142 from an inlet end 141, which can define the inlet of the fan shroud 110, to an internal interface or connection 143 with the outlet 114 at the dashed line shown in FIG. 1. The internal interface or connection 143 between the inlet 112 and the outlet 114 can also define the inner diameter of the fan shroud. The outlet 114 of the fan shroud 110 can extend from the internal interface or connection 143 along its outlet radius 144 to an outlet end 145, which can define the outlet of the fan shroud 110. The fan blade 130 can also include an axial width 135, wherein the upstream and downstream fan projection can be defined as the portion or percentage of the axial width 135 of the fan blade 130 upstream and downstream of the internal interface or connection 143 at the dashed line shown in FIG. 1, respectively.

The fan 125 can include any one of a plurality of downstream and/or upstream projections within the fan shroud 110 based upon the fan shroud 110 geometry according to any one or more of the presently disclosed embodiments, in addition to any one or more of the fan diameter 150, the geometric shape and axial width 135 of the fan blades 130, the flow system 100 restriction, and the specific diameter (Ds) of the fan 125 and shroud 110 to provide any one or more of the relative flow, total efficiency, and specific noise as disclosed herein. In particular, in one embodiment, the projection or placement of the fan 125 within the fan shroud 110 can be based, at least in part, upon the restriction level of the flow system 100 and the specific diameter of the fan assembly 102. Specific diameter can be defined as a function of the fan diameter and the flow system restriction, and can define, at least in part, the loading and/or pressure on the fan 125 as it operates to fluidly direct or convey air 160 and generate air flow through the flow system 100 from upstream of the fan 125, into, through, and out of the fan assembly 102 including the shroud 110 and fan 145 disposed therein. Specifically, in one example, the placement or projection of the fan 125 within the presently disclosed fan shroud 110 can be defined by the flow system 100 restriction and the fan assembly 102 specific diameter, and the projection of the fan 125 as well as the contour, shape, and size of the inlet radius 142 and the outlet radius 144 of the fan shroud 110 according to any of the embodiments disclosed herein can functionally and fluidly interact to provide any one or more of the relative flow, total efficiency, and specific noise as disclosed herein, wherein the downstream projection or percentage of the axial width 135 of the fan blade 130 downstream of the internal interface or connection 143 can generally increase as the specific diameter increases. In one embodiment, generally between five percent (5%) and sixty five percent (65%), and in one example, between ten percent (10%) and thirty percent (30%) of the axial width 135 of the fan blade 130 can project downstream of the internal interface or connection 143 at a specific diameter of generally 1.6. Additionally, generally between fifty five percent (55%) and ninety five percent (95%), and in one example, generally between sixty percent (60%) and ninety percent (90%) of the axial width 135 of the fan blade 130 can project downstream of the internal interface or connection 143 at a specific diameter of generally 1.9.

Furthermore, the projection or placement of the fan 125 within the fan shroud 110 can additionally be based, in part, upon a flow profile of the air 160 fluidly directed or conveyed through and downstream of the fan assembly 102, wherein the flow profile of the air 160 can be defined by any one or more of the fan diameter 150, the axial width 135 of the fan blades 130, the geometric shape and contour (if any) of the fan blades 130, in addition to any one or more of the foregoing variables, dimensions, and features of the fan assembly 102 as disclosed herein. In one embodiment, the flow profile of the air 160 can be defined by a substantially cylindrical flow profile extending axially outward from the diameter 150 of the fan 125 and downstream of the fan shroud 110, and the outlet 114 and outlet end 145 thereof. In an embodiment wherein the flow profile of the air 160 includes a substantially cylindrical downstream flow profile, generally between five percent (5%) and fifty percent (50%), and in one example, between ten percent (10%) and twenty percent (20%) of the axial width 135 of the fan blade 130 can project downstream of the internal interface or connection 143 at a specific diameter of generally 1.6. Additionally, generally between fifty five percent (55%) and eighty five percent (85%), and in one example, generally between sixty percent (60%) and seventy percent (70%) of the axial width 135 of the fan blade 130 can project downstream of the internal interface or connection 143 at a specific diameter of generally 1.9.

In another embodiment, the flow profile of the air 160 can be defined by a substantially conical or frusto-conical flow profile extending axially outward and radially inward from the diameter 150 of the fan 125 and downstream of the fan shroud 110, and the outlet 114 and outlet end 145 thereof. In an embodiment wherein the flow profile of the air 160 includes a substantially conical or frusto-conical downstream flow profile, generally between five percent (5%) and sixty five percent (65%), and in one example, between twenty percent (20%) and forty percent (40%) of the axial width 135 of the fan blade 130 can project downstream of the internal interface or connection 143 at a specific diameter of generally 1.6. Additionally, generally between seventy five percent (75%) and ninety five percent (95%), and in one example, generally between eighty percent (80%) and ninety percent (90%) of the axial width 135 of the fan blade 130 can project downstream of the internal interface or connection 143 at a specific diameter of generally 1.9.

The projection percentages and specific diameters described herein are provided as non-limiting examples for the purposes of illustration, and as a result, different projection percentages and specific diameters are contemplated without departing from the spirit and scope of the present disclosure which can provide any one or more of the relative flow, total efficiency, and specific noise as disclosed herein.

In some examples, fan shroud 110 can provide improved performance over conventional fan shrouds in many respects. Example performance metrics can include relative flow, total efficiency, and specific noise, among others.

Relative flow is generally understood to be the ratio of flow coefficients of fan shroud designs at the same loading (or restriction). In other words, relative flow can be the ratio of the volumetric airflow at the same rotational speed and diameter. Fan shroud 110 can provide a relative flow in a range of about 1.07 to about 1.11.

Total efficiency indicates power consumption for a given system restriction and airflow. Total efficiency is generally understood to be the ratio of air power (i.e., volumetric flow times the total pressure) to the mechanical input power. Fan shroud 110 can provide a total efficiency in a range of about 53% to about 61%.

Specific noise indicates the amount of overall sound emissions for a given system restriction and airflow. Specific noise is generally understood to be the A-weighted sound power level per unit airflow (in meters cubed per second) and unit total pressure (in Pascals). A-weighted sound power can be determined by adding 10 log (airflow) and 20 log (total pressure) to the specific noise. Fan shroud 110 can provide a specific noise in a range of about 34.5 dBA to about 36.5 dBA.

Figure 3:
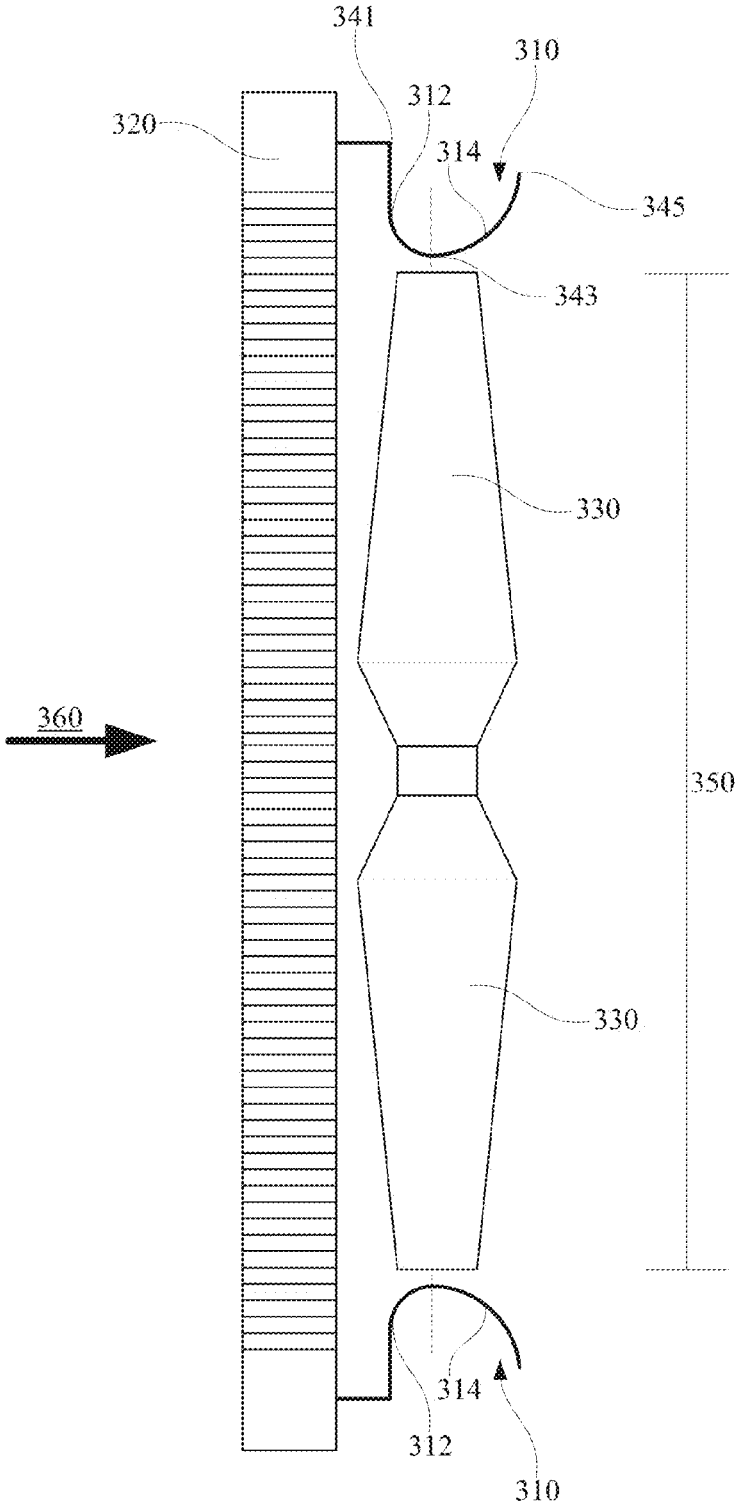
FIG. 3 is a cross-sectional view of another example double bell mouth shroud in accordance with at least one embodiment of the present disclosure.
Figure 4:
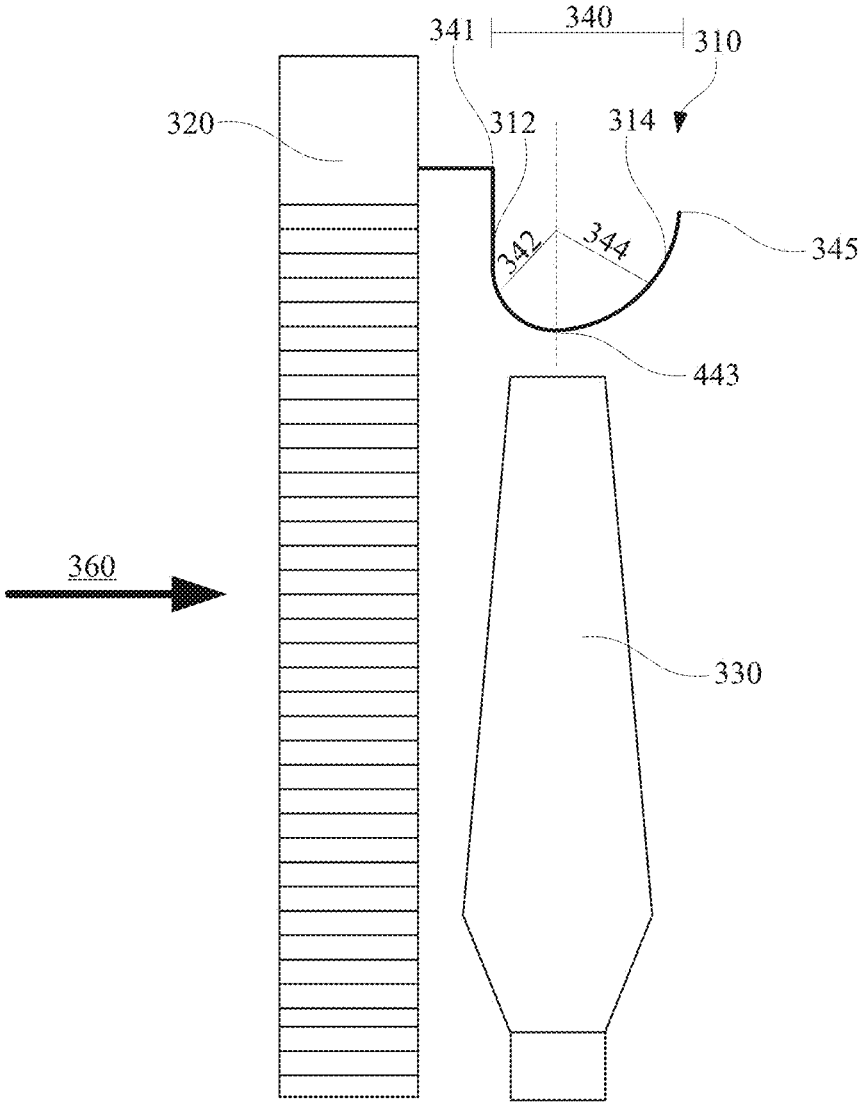
FIG. 4 is cross-sectional view of a portion of the example double bell mouth shroud of FIG. 3 in accordance with at least one embodiment of the present disclosure.

FIG. 3 is a cross-sectional view of another example fan shroud 310 in accordance with at least one embodiment of the present disclosure. FIG. 4 is cross-sectional view of a portion of the example double bell mouth shroud of FIG. 3. Similar to FIGS. 1 and 2, fan shroud 310 can be installed about and/or can encircle a fan having fan blades 330. Fan shroud 310 can be coupled to radiator 320. Fan shroud 310 can receive a flow of air 360 through a radiator 320. In this manner, fan shroud 310 can direct the air 360 around and/or through the fan. The fan can have a fan diameter 350.

Fan shroud 310 can include an inlet 312 and an out et 314. Inlet 312 can be adapted to receive the flow of air 360, while outlet 314 can be adapted to outlet the air 360. A cross-section of inlet 312 can include an inlet radius 342. Similarly, a cross-section of outlet 314 can include an outlet radius 344. Inlet 312 and outlet 314 can be coupled together. Inlet 312 of fan shroud 310 can extend along its inlet radius 342 from an inlet end 341, which can define the inlet of fan shroud 310, to an internal interface or connection 343 with outlet 314 at the dashed line shown in FIG. 3. The internal interface or connection 343 between inlet 312 and outlet 314 can also define the inner diameter of the fan shroud. Outlet 314 of fan shroud 310 can extend from the internal interface or connection 343 along its outlet radius 344 to an outlet end 345, which can define the outlet of fan shroud 310.

As previously discussed, depending on various system goals, considerations, requirements, and/or parameters such as fan noise/sound, fan airflow, total efficiency, and available space on or in a machine, example fan shrouds can be designed. In some examples, the inlet radius 342 and outlet radius 344 can be designed have a specific value relative to fan diameter 350 to meet system goals, considerations, requirements, and/or parameters. In some examples, such as the example of FIG. 3, outlet radius 344 can be about 7% of fan diameter 350. Similarly, in some examples, such as the example of FIG. 3, the inlet radius 342 can be about 4% of fan diameter 350.

Inlet 312 and outlet 314 can be directly coupled so as to not have a shroud duct between them. In conventional fan shrouds, inlets and outlets are coupled via a cylinder or shroud duct between them. Example fan shroud 310 includes a direct coupling of inlet 312 to outlet 314. In FIGS. 3 and 4, inlet 312 is delineated from outlet 314 using a dashed line.

In some examples, fan shroud 310 can have a shroud depth 340 of about 11% of fan diameter 350.

Similar to FIGS. 1 and 2, inlet 312 and outlet 314 can be substantially shaped as a bell mouth shape. The cross-section view of FIG. 3 exhibits an example inlet 312 and outlet 314 each having a bell mouth shape. From the perspective of the flow of air 360, inlet 312 can have a radially converging shape, while the outlet 314 can have a radially diverging shape.

In some examples, fan shroud 310 can provide improved performance over conventional fan shrouds in many respects. Example performance metrics can include relative flow, total efficiency, and specific noise, among others. For example, fan shroud 310 can provide a relative flow in a range of about 1.06 to about 1.09. In some examples, fan shroud 310 can provide a total efficiency in a range of about 54% to about 63%. In some examples, fan shroud 310 can provide a specific noise in a range of about 38 dBA to about 40 dBA.

Figure 5:
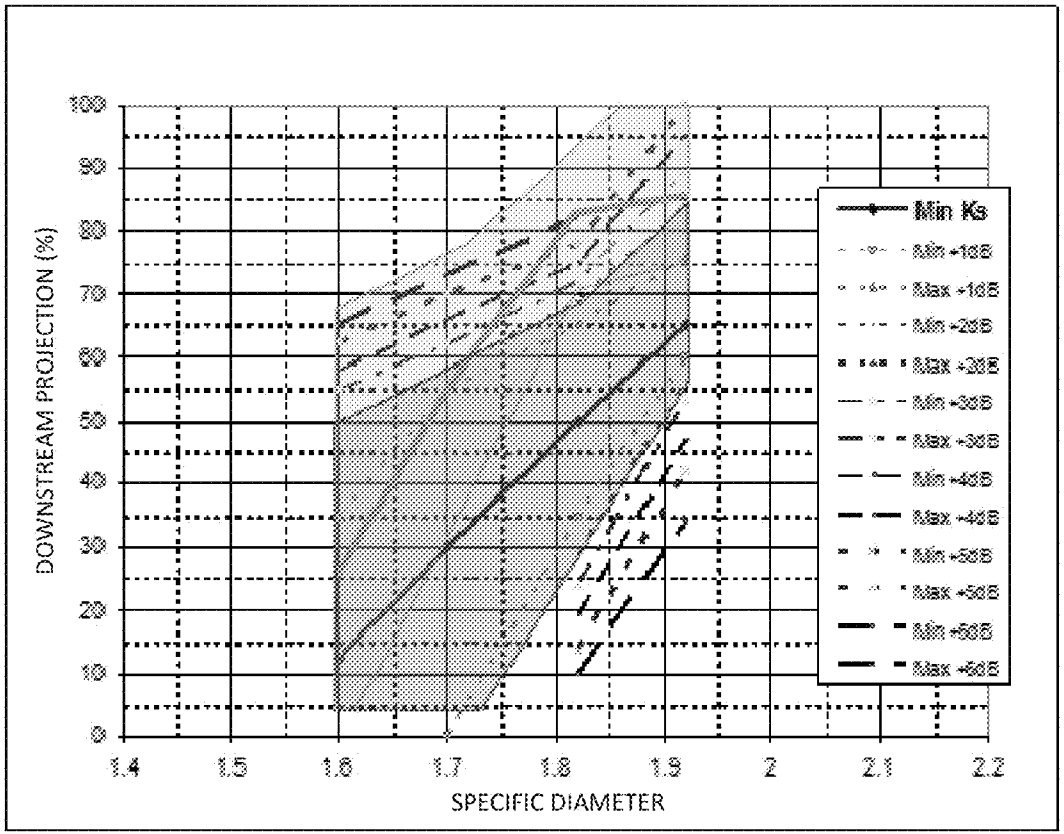
FIG. 5 depicts an example optimal fan projection map, in accordance with at least one embodiment of the present disclosure.

FIG. 5 is an example method of designing a fan shroud for a fan on a machine in accordance with at least one embodiment of the present disclosure. Example method can include deriving shroud cross section performance map(s) representing fan sound, fan airflow, and/or total efficiency as a function of a plurality of specific diameters of the fan. Example method can continue by deriving optimal fan projection map(s) (such as that depicted in FIG. 5) representing a downstream projection as a function of the plurality of specific diameters of the fan. Example method can also include selecting a design for the fan shroud for the fan based, at least in part, on the shroud cross section performance map(s). Example method can also include determining a placement of the fan shroud relative to the fan based, at least in part, on the optimal fan projection map.

In some examples, deriving shroud cross section performance map(s) can include testing the fan sound, the fan airflow, and/or the total efficiency for each of the plurality of specific diameters of the fan. Testing can include manual human testing, computer-assisted testing, and/or computer-simulated testing. Deriving shroud cross section performance map(s) can also include recording tested values of the fan sound and/or the fan airflow for each of the plurality of specific diameters of the fan. Deriving shroud cross section performance map(s) can further include recording calculated values of the total efficiency for each of the plurality of specific diameters of the fan. Deriving shroud cross section performance map(s) can also include generating the shroud cross section performance map(s) based, at least in part, on the tested values and/or the calculated values.

In some examples, deriving optimal fan projection map(s) can include generating a baseline machine specific diameter curve based, at least in part, on a measured specific diameter of the machine. Deriving optimal fan projection map(s) can also include generating a first specific diameter curve by calculating a specific diameter, $D_s$, where $$D_s = (D_f \times P_t^{0.25})/(1.2013^{0.25})(Q^{0.5})$$

$D_f$ is a fan diameter in meters, $P_t$ is a fan total pressure rise in Pascals, and Q is a fan flow rate in meters cubed per second. Deriving optimal fan projection map(s) can also include setting a fan projection based, at least in part, on a downstream projection relative to the specific diameter curve. Deriving optimal fan projection map(s) can further include testing a plurality of distinct fan projections about an expected desired fan projection. A performance parameter of the fan shroud can be reviewed as a function of the downstream projection to confirm the placement of the fan shroud.

INDUSTRIAL APPLICABILITY

The present disclosure is applicable to a variety of machines in general (e.g., track-type tractors, skid steer loaders) and fans operating in or on such machines. Fan shrouds can reduce airflow recirculation from a high pressure to a low pressure side of the fan, can reduce airflow entrance and exit losses in and out of the fan blade, and can reduce airflow separation and vortices near the fan blade tips. In some examples, a fan shroud design can have a shroud cross section which can balance input power, sound power, and flow tradeoffs with a reduced space requirement on a machine.

Fan shroud designers can need higher performing airflow systems to meet sound, airflow, and efficiency goats of a specific machine implementation. Many conventional designs are bulky and often do not fit in the cooling package space requirements. In some examples, doable bell mouth fan shrouds can improve performance of conventional fan shrouds while using up to 56% less cross sectional width.

Fan shroud designers can also find it difficult to fit conventional fan shrouds into desired space availability on a machine. Therefore, they can desire compromises to the fan shroud geometry to get it to fit on the machine, This can be difficult to do without any empirical performance tradeoff information for varying fan shroud designs. In some examples, shroud cross section performance maps can be empirically derived which identify tradeoffs and high performing cross sections. In this manner, relatively "high performing" fan shroud cross sections and their relative performance can be benchmarked against conventional cross sections.

Fan shroud designers can also find that fan projection can be an important aspect of shroud performance. In some examples, optimum shroud projection map(s) can be derived over a wide specific diameter range to reflect the specific machine's product line.

Fan shroud designers can also desire to know which geometric features of a fan shroud design should be altered (e.g., inlet/outlet radii and/or duct length) to limit performance degradation. In some examples, the conventional duct can be eliminated from the conventional fan shroud's cross section without any performance loss. In some examples, inlet radius can be altered up to 4% of fan diameter. Additionally, outlet radius can greatly affect sound, airflow, and/or efficiency performance. In some examples, maintaining at least 7% outlet radius can provide a balanced design.

It will be appreciated that the foregoing description provides examples of the disclosed system and technique. However, it is contemplated that other implementations of the disclosure can differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

We claim:

1. A fan shroud encircling a circular fan having a plurality of fan blades, each fan blade having a blade depth along an axial direction, the axial direction being parallel to an axis of rotation of the circular fan, the circular fan having a fan diameter along a radial direction, the radial direction being perpendicular to the axial direction, the fan shroud comprising:

an inlet configured to receive a flow of air and including an inlet surface defining an inlet flow path therethrough, the inlet surface extending upstream of the circular fan along a flow direction through the circular fan, a cross section of the inlet surface lying in a plane defined by the axial direction and the radial direction having an inlet radius, a center of the inlet radius being disposed on a side of the inlet surface opposite the inlet flow path; and an outlet coupled to the inlet and configured to discharge the flow of air, the outlet including an outlet surface defining an outlet flow path therethrough, the outlet surface extending downstream of the circular fan along the flow direction through the circular fan, a cross section of the outlet surface lying in the plane defined by the axial direction and the radial direction having an outlet radius ranging from 7% to 10% of the fan diameter.

2. The fan shroud of claim 1, wherein the inlet radius is 10% of the fan diameter.

3. The fan shroud of claim 1, wherein a shroud depth is defined by an overall length of the fan shroud along the axial direction, and wherein the shroud depth is 20% of the fan diameter.

4. The fan shroud of claim 1, wherein the inlet and the outlet are directly coupled to each other without a shroud duct between the inlet and the outlet.

5. The fan shroud of claim 1, wherein the inlet surface and the outlet surface each include a substantially bell mouth shape.

6. The fan shroud of claim 1, wherein the inlet radius is 4% of the fan diameter.

7. The fan shroud of claim 1, wherein a cross-section of the fan shroud includes a shroud depth; and wherein the shroud depth is 11% of the fan diameter.

8. The fan shroud of claim 1, wherein the inlet and the outlet are each substantially a bell mouth shape.

9. The fan shroud of claim 1, wherein a center of the outlet radius is disposed on a side of the outlet surface opposite the outlet flow path.

10. The fan shroud of claim 9, wherein the center of the inlet radius is collocated with the center of the outlet radius.

11. The fan shroud of claim 1, wherein the inlet surface adjoins the outlet surface at a point, the inlet radius extends to the point, and the outlet radius extends to the point.

12. The fan shroud of claim 11, wherein a slope of the inlet surface, with respect to the axial direction and the radial direction, at the point does not equal a slope of the outlet surface, with respect to the axial direction and the radial direction, at the point.

13. A fan shroud encircling a circular fan having a plurality of fan blades, each fan blade having a blade depth along an axial direction, the axial direction being parallel to an axis of rotation of the circular fan, the circular fan having a fan diameter along a radial direction, the radial direction being perpendicular to the axial direction, the fan shroud comprising:

an inlet configured to receive a flow of air and including an inlet surface defining an inlet flow path therethrough, the inlet surface extending upstream of the circular fan along a flow direction through the circular fan, a cross section of the inlet surface lying in a plane defined by the axial direction and the radial direction having an inlet radius, a center of the inlet radius being disposed on a side of the inlet surface opposite the inlet flow path; and an outlet directly coupled to the inlet and configured to discharge the flow of air, the outlet including an outlet surface defining an outlet flow path therethrough, the outlet surface extending downstream of the circular fan along the flow direction through the circular fan, a cross section of the outlet surface lying in the plane defined by the axial direction and the radial direction having an outlet radius ranging from 7% to 10% of the fan diameter, wherein the fan shroud provides a downstream projection of 5% to 65% at a specific diameter of 1.6.

14. The fan shroud of claim 13, wherein the downstream projection is 10% to 30% at the specific diameter of 1.6.

15. The fan shroud of claim 13, wherein the fan shroud provides a downstream projection of 55% to 95% at a specific diameter of 1.9.

16. The fan shroud of claim 15, wherein the downstream projection is 60% to 90% at the specific diameter of 1.9.

17. The fan shroud of claim 13, wherein the inlet surface adjoins the outlet surface at a point, the inlet radius extends to the point, and the outlet radius extends to the point.

18. The fan shroud of claim 17, wherein a slope of the inlet surface, with respect to the axial direction and the radial direction, at the point does not equal a slope of the outlet surface, with respect to the axial direction and the radial direction, at the point.

19. A land-based construction machine, comprising:

a circular fan configured to move a flow of air along a flow direction extending at least one of toward the machine and away from the machine, the circular fan having a fan diameter along a radial direction and having a plurality of fan blades, each fan blade of the plurality of fan blades having a blade depth along an axial direction, the axial direction being parallel to an axis of rotation of the circular fan, the radial direction being perpendicular to the axial direction; and a fan shroud encircling the circular fan, the fan shroud comprising an inlet configured to receive the flow of air and including an inlet surface defining an inlet flow path therethrough, the inlet surface extending upstream of the circular fan along a flow direction through the circular fan, a cross section of the inlet surface lying in a plane defined by the axial direction and the radial direction having an inlet radius, and an outlet directly coupled to the inlet and configured to discharge the flow of air, the outlet including an outlet surface defining an outlet flow path therethrough, the outlet surface extending downstream of the circular fan along the flow direction through the circular fan, a cross section of the outlet surface lying in the plane defined by the axial direction and the radial direction having an outlet radius ranging from 7% to 10% of the fan diameter.

20. The machine of claim 19, wherein the machine comprises at least one of an off-highway truck, an earth-moving machine, a wheel loader, an excavator, a dump truck, a backhoe, a motor grader, and a material handler.

* * * * *